US006451745B1

(12) United States Patent
Ward

(10) Patent No.: US 6,451,745 B1
(45) Date of Patent: Sep. 17, 2002

(54) HIGH BORON FORMULATIONS FOR FLUIDS CONTINUOUSLY VARIABLE TRANSMISSIONS

(75) Inventor: William C. Ward, Perry, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/532,528

(22) Filed: Mar. 21, 2000

Related U.S. Application Data

(60) Provisional application No. 60/134,890, filed on May 19, 1999.

(51) Int. Cl.[7] ..... C10M 133/16; C10M 139/00

(52) U.S. Cl. ..... 508/192; 508/186; 508/189

(58) Field of Search ..... 508/186, 189, 508/192

(56) References Cited

U.S. PATENT DOCUMENTS

| | | | | |
|---|---|---|---|---|
| 4,159,957 A | | 7/1979 | de Vries | 252/33.4 |
| 4,539,126 A | | 9/1985 | Bleeker et al. | 252/39 |
| 4,792,410 A | | 12/1988 | Schwind et al. | 252/33.4 |
| 4,842,755 A | | 6/1989 | Dunn | 252/32.7 |
| 4,948,522 A | | 8/1990 | Dunn et al. | 252/32.7 |
| 5,098,587 A | | 3/1992 | Hoornaert et al. | 252/33.4 |
| 5,346,636 A | | 9/1994 | Parc et al. | 252/49.9 |
| 5,525,247 A | | 6/1996 | Miyaji et al. | 252/18 |
| 5,750,477 A | | 5/1998 | Sumiejski et al. | 252/18 |
| 5,759,964 A | | 6/1998 | Sumiejski | 508/186 |
| 6,103,673 A | * | 8/2000 | Sumiejski et al. | 508/186 |
| 6,251,840 B1 | * | 6/2001 | Ward, Jr. et al. | 508/162 |
| 6,303,546 B1 | * | 10/2001 | Hata et al. | 508/192 |

FOREIGN PATENT DOCUMENTS

| | | |
|---|---|---|
| EP | 0 132 383 | 1/1985 |
| EP | 0 646 639 | 4/1995 |
| EP | 0695 799 | 2/1996 |
| EP | 761 805 | 3/1997 |
| EP | 0 798 367 | 10/1997 |

* cited by examiner

*Primary Examiner*—Jacqueline V. Howard
(74) *Attorney, Agent, or Firm*—David M. Shold; Michael F. Esposito

(57) ABSTRACT

Continuously variable transmission can be lubricated by supplying to them a composition of (a) an oil of lubricating viscosity; (b) a dispersant; and (c) a detergent. At least one of the dispersant (b) and the detergent (c) is a borated species, and the amount of boron present in the composition is sufficient to impart improved friction and anti-seizure properties to the composition when employed in said transmission.

38 Claims, No Drawings

HIGH BORON FORMULATIONS FOR FLUIDS CONTINUOUSLY VARIABLE TRANSMISSIONS

This application claims priority from U.S. Provisional Application Ser. No. 60/134,890, filed May 19, 1999.

BACKGROUND OF THE INVENTION

The present invention relates to high-boron formulations suitable for use as fluids for continuously variable transmissions.

Continuously variable transmissions (CVT) represent a radical departure from conventional automatic transmissions. The push belt version of the CVT was invented by Dr. Hub Van Doorne, and since its introduction, many cars have been equipped with the push belt CVT system. CVT push belts are manufactured by Van Doorne's Transmissie VB of Tilburg, the Netherlands. A more detailed description of such transmissions and belts and lubricants employed therein is found in European Patent Application 753 564, published Jan. 15, 1997, as well as references cited therein. In brief, a belt and pulley system is central to the operation of this type of transmission. The pulley system comprises a pair of pulleys with a V-shaped cross-section, each consisting of a moveable sheave, a fixed sheave, and a hydraulic cylinder. Between the pulleys runs , a belt, which consists of a set of metal elements held together by metal bands. In operation, the driving pulley pushes the belt to the driven pulley, thereby transferring power from the input to the output. The transmission drive ratio is controlled by opening or closing the moveable sheaves so that the belt rides lower or higher on the pulley faces. This manner of operation permits continuous adjustment of gear ratio between the input and output shafts.

It has become clear from commercial use of the CVT that the fluids used in the CVT are just as important as the mechanical design for satisfactory operation. The lubricant must fulfill several functions: to lubricate the metal belt in its contacts with the pulley assembly, the planetary and other gears, the wet-plate clutches, and the bearings; to cool the transmission; and to carry hydraulic signals and power. The hydraulic pressure controls the belt traction, transmission ratio, and clutch engagement. The lubricant must provide the appropriate degree of friction between the belt and pulley assembly, to avoid the problem of slippage on one hand, and binding on the other, all the while providing protection to the metal surfaces from pitting, scuffing, scratching, flaking, polishing, and other forms of wear. Accordingly, the fluid should maintain a relatively high coefficient of friction for metal/metal contact, as well as exhibiting a suitable degree of shear stability.

U.S. Pat. No. 5,759,964, Sumiejski, Jun. 2, 1998 discloses an antiwear enhancing composition for lubricants and functional fluids such as automatic transmission fluids. It comprises a boron-containing overbased material; a phosphorus acid, ester, or derivative thereof, and a borated epoxide or borated fatty acid ester of glycerol.

U.S. Pat. No. 4,948,522, Dunn et al., Aug. 14, 1990, discloses a dispersant additive package for marine diesel engines comprising an oil of lubricating viscosity, a borated ashless dispersant, and one or more overbased metal compounds.

U.S. Pat. No. 5,750,477, Sumiejski et al., May 12, 1998, which is equivalent to EP 0 753 564 referred to above, discloses a shear stable lubricating/functional fluid composition, comprising an oil of lubricating viscosity, 1-15% by weight of the metal salt of an organic acid, and 1-25% viscosity modifier, wherein the composition has certain defined viscosity. Other components in the additive package include a metal dialkyl dithiophosphate, sulfur containing friction modifiers, dialkyl phosphites, and fatty amides.

European Application 761 805, Mar. 12, 1997, discloses a lubricating/functional fluid which comprises an oil of lubricating viscosity, 2,5dimercapto-1,3,4-thiadiazole or a derivative thereof and an antifoam agent. The composition may include phosphoric acid. Friction modifiers are included in the compositions in the amounts of 0.1–10 weight percent and may be a single friction modifier or mixtures of two or more. Friction modifiers also include metal salts of fatty acids. Preferred cations are zinc, magnesium, calcium, and sodium and any other alkali, or alkaline earth metals may be used. The salts may be overbased by including an excess of cations per equivalent of amine [sic; acid?]. Zinc salts are added in amounts of 0.1–5 weight percent to provide antiwear protection. The zinc salts are normally added as zinc salts of phosphorodithioic acids.

U.S. Pat. No. 4,792,410, Dec. 20, 1988, Schwind et al., discloses a lubricant mixture suitable for a manual transmission fluid, comprising a boronated overbased alkali metal or alkaline earth metal salt, a friction modifier or mixture of friction modifiers such as e.g. fatty acid amides and borated derivatives, and an oil of lubricating viscosity. Other typical ingredients may be included.

The metal-metal coefficient of friction and the antiseizure properties of CVT fluids are important performance parameters for the effective application of continuously variable transmissions. It is generally known that formulations containing zinc salts such as primary zinc dihydrocarbyl dithiophosphates resist metal-metal seizure and maintain high metal-metal coefficients of friction at the CVT belt-pulley interface. It is, however, desirable to formulate CVT fluids with compositions similar to automatic transmission fluids (ATFs). ATFs are generally not formulated with zinc dihydrocarbyl dithiophosphates because of their low thermal and oxidative stability and their known problems with clutch incompatibility.

The present invention, therefore, solves the problem of providing a suitable CVT fluid with exceptional metal-metal friction and good antiseizure properties, preferably free from primary zinc dihydrocarbyl dithiophosphates, by means of including boronated detergents and/or dispersants. The amount of zinc dihydrocarbyl dithiophosphates in the fully formulated CVT fluid is therefore preferably less than 1 percent, more preferably less than 0.5 percent, 0.1 percent, or 0.05%. The most preferred compositions are substantially free from zinc dihydrocarbyl dithiophosphates, e.g, less than 0.01 percent.

The compositions of the present invention can be used as lubricating oils and greases useful in industrial applications and in automotive engines, transmissions and axles. These compositions are effective in a variety of applications including crankcase lubricating oils for spark-ignited and compression-ignited internal combustion engines, including automobile and truck engines, two-cycle engines, aviation piston engines, marine and low-load diesel engines, and the like. They are also useful as additives for traction fluids. Also, automatic transmission fluids, manual transmission fluids, transaxle lubricants, gear lubricants, metalworking lubricants, hydraulic fluids, and other lubricating oil and grease compositions can benefit from the incorporation of the compositions of this invention. The inventive functional fluids are particularly effective as automatic transmission fluids, particularly fluids for continuously variable transmissions, including push-belt type and toroidal traction drive transmissions.

SUMMARY OF THE INVENTION

The present invention provides formulations suitable for use as fluids for continuously variable transmissions, comprising:

(a) an oil of lubricating viscosity; and (b) a dispersant; or (c) a detergent; or mixtures of (b) and (c);

wherein at least one of the dispersant (b) and the detergent (c) is a borated species and wherein the amount of boron supplied to the formulation is sufficient to impart improved friction and anti-seizure properties to said formulation.

The present invention further provides a method for lubricating a continuously variable transmission, comprising imparting to said transmission the aforedescribed formulation.

DETAILED DESCRIPTION OF THE INVENTION

Various preferred features and embodiments will be described below by way of non-limiting illustration.

The first component of the present invention is an oil of lubricating viscosity which is generally present in a major amount (i.e. an amount greater than 50% by weight). Generally, the oil of lubricating viscosity is present in an amount of greater than 80% by weight of the composition, typically at least 85%, preferably 90 to 95%. Such oil can be derived from a variety of sources, and includes natural and synthetic lubricating oils and mixtures thereof.

The natural oils useful in making the inventive lubricants and functional fluids include animal oils and vegetable oils (e.g., lard oil, castor oil) as well as mineral lubricating oils such as liquid petroleum oils and solvent treated or acid-treated mineral lubricating oils of the paraffinic, naphthenic or mixed paraffinic/naphthenic types which may be further refined by hydrocracking and hydrofinishing processes and are dewaxed. Oils of lubricating viscosity derived from coal or shale are also useful. Useful natural base oils may be those designated by the American Petroleum Institute (API) as Group I, II, or III oils. Group I oils contain <90% saturates and/or >0.03% sulfur and have a viscosity index (VI) of ≧80. Group II oils contain ≧90% saturates, ≦0.03% sulfur, and have a VI ≧80. Group III oils are similar to group II but have a VI ≧120.

Upon occasion, highly refined or hydrocracked natural oils have been referred to as "synthetic" oils. More commonly, however, synthetic lubricating oils are understood to include hydrocarbon oils and halo-substituted hydrocarbon oils such as polymerized and interpolymerized olefins (e.g., polybutylenes, polypropylenes, propylene-isobutylene copolymers, chlorinated polybutylenes); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulfides and the derivatives, analogs and homologs thereof and the like. Polyalpha olefin oils are also referred to as API Group IV oils.

Alkylene oxide polymers and interpolymers and derivatives thereof where the terminal hydroxyl groups have been modified such as by esterification or etherification constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of 500-1000, or diethyl ether of polypropylene glycol having a molecular weight of 1000-1500) or mono- and polycarboxylic esters thereof, for example, the acetic acid esters, mixed $C_{3-8}$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, or alkenyl malonic acids) with a variety of alcohols (e.g., butyl alcohol, hexyl alcohol, dodecyl alcohol, 2-ethylhexyl alcohol, ethylene glycol, diethylene glycol monoether, or propylene glycol) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, or tripentaerythritol.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl) silicate, hexyl-(4-methyl-2pentoxy) disiloxane, poly(methyl) siloxanes, poly(methylphenyl) siloxanes). Other synthetic lubricating oils include liquid esters of phosphorus-containing acids (e.g., tricresyl phosphate, trioctyl phosphate, diethyl ester of decane phosphonic acid), polymeric tetrahydrofurans and the like.

Another class of oils is known as traction oils, which are typically synthetic fluids containing a large fraction of highly branched or cycloaliphatic structures, i.e., cyclohexyl rings. Traction oils or traction fluids are described in detail, for example, in U.S. Pat. Nos. 3,411,369 and 4,704,490.

Unrefined, refined, and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, hydroprocessing, hydrocracking, and hydrotreating. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

In one embodiment, the oil of lubricating viscosity is a poly-alpha-olefin (PAO). Typically, the poly-alpha-olefins are derived from monomers having from 4 to 30, or from 4 to 20, or from 6 to 16 carbon atoms. Examples of useful PAOs include those derived from 1-decene. These PAOs may have a viscosity from 2 to 150.

Preferred base oils include poly-α-olefins such as oligomers of 1-decene. These synthetic base oils are hydrogenated resulting in an oil of stability against oxidation. The synthetic oils may encompass a single viscosity range or a mixture of high viscosity and low viscosity range oils so long as the mixture results in a viscosity which is consistent with the requirements set forth below. Also included as preferred base oils are highly hydrocracked and dewaxed oils. These petroleum oils are generally refined to give enhanced low temperature viscosity and antioxidation performance. Mixtures of synthetic oils with refined mineral oils may also be employed.

Another required component of the present invention is a dispersant. Dispersants include acylated amines, carboxylic esters, Mannich reaction products, hydrocarbyl substituted amines, and mixtures thereof.

The acylated amines include reaction products of one or more carboxylic acylating agent and one or more amine. The carboxylic acylating agents include $C_{8-30}$ fatty acids, $C_{14-20}$ isoaliphatic acids, $C_{18-44}$ dimer acids, addition dicarboxylic acids, trimer acids, addition tricarboxylic acids, and hydrocarbyl substituted carboxylic acylating agents. Dimer acids are described in U.S. Pat. Nos. 2,482,760, 2,482,761, 2,731,481, 2,793,219, 2,964,545, 2,978,468, 3,157,681, and 3,256,304. The addition carboxylic acylating agents are addition (4+2 and 2+2) products of an unsaturated fatty acid with one or more unsaturated carboxylic reagents, which are described above. These acids are taught in U.S. Pat. No. 2,444,328. In another embodiment, the carboxylic acylating agent is a hydrocarbyl substituted carboxylic acylating agent. The hydrocarbyl substituted carboxylic acylating agents are prepared by a reaction of one or more of the above olefins or polyalkenes with one or more of the above unsaturated carboxylic reagents, such as maleic anhydride. The amines can be any of those described elsewhere herein, preferably a polyamine, such as an alkylenepolyamine or a condensed polyamine. Acylated amines, their intermediates and methods for preparing the same are described in U.S. Pat. Nos. 3,219,666; 4,234,435; 4,952,328; 4,938,881; 4,957,649; 4,904,401; and 5,053,152.

In another embodiment, the dispersant can also be a carboxylic ester. The carboxylic ester is prepared by reacting at least one or more of the above carboxylic acylating agents, preferably a hydrocarbyl substituted carboxylic acylating agent, with at least one organic hydroxy compound and optionally an amine. The hydroxy compound can be an alcohol or a hydroxy containing amine. In another embodiment, the carboxylic ester dispersant is prepared by reacting the acylating agent with at least one of the above-described hydroxyamines. The alcohols are described above. Preferred alcohols are the above polyhydric alcohols, such pentaerythritol.

The polyhydric alcohols can be esterified with monocarboxylic acids having from 2 to 30, or from 8 to 18 carbon atoms, provided that at least one hydroxyl group remains unesterified. Examples of monocarboxylic acids include acetic, propionic, butyric and above described fatty acids. Specific examples of these esterified polyhydric alcohols include sorbitol oleate, including mono- and dioleate, sorbitol stearate, including mono- and distearate, glycerol oleate, including glycerol mono-, di- and trioleate and erythritol octanoate.

The carboxylic ester dispersants can be prepared by any of several known methods. The method which is preferred because of convenience and the superior properties of the esters it produces, involves the reaction of the carboxylic acylating agents described above with one or more alcohol or phenol in ratios from 0.5 equivalent to 4 equivalents of hydroxy compound per equivalent of acylating agent. The preparation of useful carboxylic ester dispersant is described in U.S. Pat. Nos. 3,522,179 and 4,234,435.

The carboxylic ester dispersants can be further reacted with at least one of the above described amines and preferably at least one of the above described polyamines, such as a polyethylenepolyamine, condensed polyamine, or a heterocyclic amine, such as aminopropylmopholine. The amine is added in an amount sufficient to neutralize any non-esterified carboxyl groups. In one embodiment, the carboxylic ester dispersants are prepared by reacting from 1 to 2 equivalents, or from 1.0 to 1.8 equivalents of hydroxy compounds, and up to 0.3 equivalent, or from 0.02 to 0.25 equivalent of polyamine per equivalent of acylating agent. The carboxylic acid acylating agent can be reacted simultaneously with both the hydroxy compound and the amine. There is generally at least 0.01 equivalent of the alcohol and at least 0.01 equivalent of the amine although the total amount of equivalents of the combination should be at least 0.5 equivalent per equivalent of acylating agent. These carboxylic ester dispersant compositions are known in the art, and the preparation of a number of these derivatives is described in, for example, U.S. Pat. Nos. 3,957,854 and 4,234,435.

In another embodiment, the dispersant can also be a hydrocarbyl-substituted amine. These hydrocarbyl-substituted amines are well known to those skilled in the art. These amines, and methods of making them, are disclosed in U.S. Pat. Nos. 3,275,554; 3,438,757; 3,454,555; 3,565,804; 3,755,433; and 3,822,289. Typically, hydrocarbyl substituted amines are prepared by reacting olefins and olefin polymers, including the above polyalkenes and halogenated derivatives thereof, with amines (mono- or polyamines). The amines can be any of the amines described above, preferably an alkylenepolyamine. Examples of hydrocarbyl substituted amines include poly(propylene)amine; N,N-dimethyl-N-poly(ethylene/propylene)amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutenemorpholine; N-poly(butene)ethylenediamine; N-poly(propylene) trimethylenediamine; N-poly(butene)diethylenetriamine; N',N'-poly(butene)tetraethylenepentamine; N,N-dimethyl-N'-poly(propylene)-1,3-propylenediamine and the like.

In another embodiment, the dispersant can also be a Mannich dispersant. Mannich dispersants are generally formed by the reaction of at least one aldehyde, such as formaldehyde and paraformaldehyde, at least one of the above described amines, preferably a polyamine, such as a polyalkylenepolyamine, and at least one alkyl substituted hydroxyaromatic compound. The amounts of the reagents is such that the molar ratio of hydroxyaromatic compound to formaldehyde to amine is in the range from (1:1:1) to (1:3:3). The hydroxyaromatic compound is generally an alkyl substituted hydroxyaromatic compound. This term includes the above described phenols. The hydroxyaromatic compounds are those substituted with at least one, and preferably not more than two, aliphatic or alicyclic groups having from 6 to 400, or from 30 to 300, or from 50 to 200 carbon atoms. These groups can be derived from one or more of the above described olefins or polyalkenes. In one embodiment, the hydroxyaromatic compound is a phenol substituted with an aliphatic or alicyclic hydrocarbon-based group having an $\overline{M}_n$ of 420 to 10,000. Mannich dispersants are described in the following U.S. Pat. No. 3,980,569; 3,877,899; and 4,454,059.

In one embodiment, the dispersant is a borated dispersant. Typically, the borated dispersant contains from 0.1% to 5%, or from 0.5% to 4%, or from 0.7% to 3% by weight boron. In one embodiment, the borated dispersant is a borated acylated amine, such as a borated succinimide dispersant. Borated dispersants are described in U.S. Pat. Nos. 3,000,916; 3,087,936; 3,254,025; 3,282,955; 3,313,727; 3,491,025; 3,533,945; 3,666,662, 4,925,983 and 5,883,057. Borated dispersants are prepared by reaction of one or more dispersants with one or more boron compounds.

Suitable boron compounds for preparing borated dispersants include various forms of boric acid (including metaboric acid, $HBO_2$, orthoboric acid, $H_3BO_3$, and tetraboric acid, $H_2B_4O_7$), boric oxide, boron trioxide, and alkyl borates of the formula $(RO)_xB(OH)_y$ wherein x is 1 to 3 and y is 0 to 2, the sum of x and y being 3, and where R is an alkyl group containing 1 to 6 carbon atoms. In one embodiment, the boron compound is an alkali or mixed alkali metal and alkaline earth metal borate. These metal borates are generally a hydrated particulate metal borate which are known in the art. Alkali metal borates include mixed alkali and alkaline metal borates. These metal borates are available commercially. Representative patents disclosing suitable alkali and alkali metal and alkaline earth metal borates and their methods of manufacture include U.S. Pat. Nos. 3,997,454; 3,819,521; 3,853,772; 3,907,601; 3,997,454; and 4,089,790.

The dispersant can also be a mixture of one or more borated dispersants with one or more non-borated dispersants.

Dispersants can also be post-treated by reaction with any of a variety of agents besides borating agents. Among these are urea, thiourea, dimercaptothiadiazoles, carbon disulfide, aldehydes, ketones, carboxylic acids, hydrocarbon-substituted succinic anhydrides, nitrites, epoxides, and phosphorus compounds. References detailing such treatment are listed in U.S. Pat. No. 4,654,403.

The amount of the dispersant on an oil free basis in the fully formulated fluids of the present invention is preferably 0.1 or 0.2 to 6 or 10 percent by weight, preferably 0.3 or 0.5 to 3 or 5 percent, and more preferably 1 or 2 to 3 or 4 percent. The dispersant, when it is borated, will preferably contribute 50 to 3000 parts per million (ppm) boron, more preferably 80 to 1500 ppm, and still more preferably 150, 200, 250, or 500 ppm to 1200 ppm boron, to the fully formulated fluid.

Another required component of the present invention is a detergent, which is typically in the form of an overbased metal salt. Overbased materials are generally single phase, homogeneous Newtonian systems characterized by a metal content in excess of that which would be present for neutralization according to the stoichiometry of the metal and the particular acidic organic compound reacted with the metal. The overbased materials are most commonly prepared by reacting an acidic material (typically an inorganic acid or lower carboxylic acid, preferably carbon dioxide) with a mixture comprising an acidic organic compound, a reaction medium comprising at least one inert, organic solvent (such as mineral oil, naphtha, toluene, or xylene) for said acidic organic material, a stoichiometric excess of a metal base, and a promoter such as a phenol or alcohol. The detergent component of the present additive mixture can be one or more borated or non-borated overbased alkali metal or alkaline earth metal salts of a sulfonic acid, phenol, salicylic acid, glyoxylic acid, carboxylic acid, or phosphorus-containing acid, or mixtures thereof. The term "salicylate" is used herein, as commonly in the art, to preferably mean salts of hydrocarbyl-substituted salicylic acid.

Sulfonate salts are those having a substantially oleophilic character and which are formed from organic materials. Organic sulfonates are well known materials in the lubricant and detergent arts. The sulfonate compound should contain on average 10 to 40 carbon atoms, preferably 12 to 36 and more preferably 14 to 32 carbon atoms. Similarly, the phenates, salicylates, and carboxylates should have a substantially oleophilic character. While the carbon atoms can be either in an aromatic or paraffinic configuration, it is preferred that alkylated aromatics be used. While naphthalene based materials can be used, the preferred aromatic materials are based on benzene.

A highly preferred composition is a monosulfonated alkylated benzene, preferably the monoalkylated benzene. Typically, alkyl benzene fractions are obtained from still bottom sources and are mono- or di-alkylated. It is believed that the mono-alkylated aromatics are superior in overall properties.

It is desirable that a mixture of mono-alkylated aromatics be used to obtain the mono-alkylated salt (benzene sulfonate). Mixtures in which a substantial portion of the composition contains polymers of propylene as the source of the alkyl groups assist in the solubility of the salt in the transmission fluids of the present invention. The use of mono-functional (e.g., mono-sulfonated) materials avoids crosslinking of the molecules and possible precipitation of the salt from the lubricant.

The detergent is referred to as "overbased." By overbasing, it is meant that a stoichiometric excess of the metal be present, beyond that required to neutralize the anion of the salt. The excess metal from overbasing has the effect of neutralizing acids which may build up in the lubricant. Another important advantages is that the overbased salt increases the dynamic coefficient of friction. The overbasing is generally done such that the metal ratio is at least 1.05:1, preferably 2:1 to 30:1, and most preferably 4:1 to 25:1. The metal ratio is the ratio of metal ions, on an equivalent basis, to the anionic portion of the overbased material.

Preferably the overbased material is in the form of a metal salt where the metal is selected from group II of the periodic table of elements. Preferably it is a calcium or magnesium salt.

Preferably the overbased material is a carbonated material. Carbonated overbased materials are those which the low molecular weight acidic material which is preferably used in the formation of the material is carbon dioxide. The preparation of overbased materials, including carbonated overbased materials, is well known and is described, in numerous United States patents including, for example, U.S. Pat. No. 3,766,067, McMillen.

Preferably the overbased material is a carbonated overbased calcium sulfonate or a carbonated overbased calcium salicylate.

The overbased material can be borated or non-borated, as described below. The overbased material (detergent) can also be a mixture of one or more borated detergents with one or more non-borated detergents. Borated overbased materials and their preparation are well known and are described in greater detail in European Patent Application 753,564, published Jan. 15, 1997 and in U.S. Pat. No. 4,792,410.

Boronating agents include those described above in reference to the borated dispersants. An alkali metal borate dispersion can be prepared by the following steps: a suitable reaction vessel is charged with an alkaline metal carbonate overbased metal sulfonate within an oleophilic reaction medium (typically the hydrocarbon medium employed to prepare the overbased metal sulfonate). Boric acid is then charged to the reaction vessel and the contents vigorously agitated. The reaction is typically conducted for a period of 0.5 to 7 hours, usually from 1 to 3 hours at a reaction temperature of 20° C. to 200° C., preferably from 20° C. to 150° C., and more preferably from 40° C. to 125° C. At the end of the reaction period, the temperature is typically raised to 100° C. to 250° C., preferably from 100° C. to 150° C. to strip the medium of any residual alcohol and water. The stripping can be done at atmosphere pressure or under reduced pressure of, e.g., 93 kPa to 1 kPa.

The detergent, when it is borated, will preferably contribute 50 to 3000 parts per million (ppm) boron, more preferably 80 to 1500 ppm, and still more preferably 150, 200, 250, or 500 ppm to 1200 ppm boron, to the fully formulated fluid.

The total amount of oil free detergent in the fully formulated fluid is preferably 0.1 to 10 percent by weight, more preferably 0.2 to 5 percent, and still more preferably 0.3 to 2.5 percent by weight. The desirable amount of overbased detergent is that which is suitable to impart a specific amount of basicity to the formulation, and for that reason relatively lower amounts of high TBN detergents will normally be used and relatively higher amounts of low TBN detergent will normally be used. When a 300 TBN calcium detergent is used, typical amounts on an oil free basis will be 0.1 to 2 percent, preferably 0.3 to 1 percent, more preferably 0.5 to 0.7 percent. When a 10 TBN calcium detergent is used, typical amounts on an oil free basis will be 0.5 to 10 percent, preferably 1 to 4 percent. The total amount of calcium detergent is typically an amount suitable to provide 150 to 5000 parts per million calcium to the composition, preferably 300 to 2500 ppm, more preferably 600 to 1250 ppm. If other metals than calcium are used, the amounts will be adjusted accordingly to provide a comparable level of basicity.

The amount of the boron additive is to be a sufficient level to provide friction and antiseizure properties similar to those achieved by the use of zinc dialkyldithiophosphates. The preferred total amount of boron present in the fully formulated composition is at least 130 or 200 ppm, preferably at least 250 ppm, more preferably 400 to 3300 or 2000 ppm, and even more preferably 600 or 700 to 1700 or 1300 ppm. The boron component can be supplied by use of a borated dispersant or by use of a borated detergent. Preferably both the detergent and dispersant are borated.

The compositions of the present invention will generally contain other additives commonly used for ATFs or fluids for CVTs.

One common component for ATFs or CVT fluids is a viscosity modifier, ("VM," also referred to as a viscosity index improver). Viscosity modifiers are extremely well known in the art and most are commercially available. Hydrocarbon VMs include polybutenes, poly(ethylene ipropylene) copolymers, and polymers of styrene with butadiene or isoprene. Ester VMs include esters of styrene/maleic anhydride polymers, esters of styrene/maleic anhydride/acrylate terpolymers, and polymethacrylates. The acrylates are available from RohMax and from The Lubrizol Corporation; polybutenes from Ethyl Corporation and Lubrizol; ethylenelpropylene copolymers from Exxon and Texaco; polystyrene/isoprene polymers from Shell; styrene/maleic esters from Lubrizol, and styrene/butadiene polymers from BASF.

Preferred VMs include acrylate- or methacrylate-containing copolymers or copolymers of styrene and an ester of an unsaturated carboxylic acid such as styrene/maleic ester (typically prepared by esterification of a styrene/maleic anhydride copolymer). Preferably the viscosity modifier is a polymethacrylate viscosity modifier. Polymethacrylate viscosity modifiers are prepared from mixtures of methacrylate monomers having different alkyl groups. The alkyl groups may be either straight chain or branched chain groups containing from 1 to 18 carbon atoms. When a small amount of a nitrogen-containing monomer is copolymerized with alkyl methacrylates, dispersancy properties are also incorporated into the product. Thus, such a product has the multiple function of viscosity modification, pour point depressancy and dispersancy. Such products have been referred to in the art as dispersant-type viscosity modifiers or simply dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers. It is preferred that the viscosity modifier of the present invention is a dispersant viscosity modifier.

Some of the nitrogen-containing dispersant viscosity modifiers of the present invention can be prepared by a process comprising reacting, in the presence of a free radical initiator, (A) 55% to 99.9% by weight, preferably 75 to 99.5% by weight, more preferably 90 to 99%, often 80 to 99% by weight of one or more alkyl acrylate ester monomers containing from 1 to 24 carbon atoms in the ester alkyl group, wherein at least 50 mole % of the esters contain at least 6 carbon atoms, preferably at least 8 carbon atoms, in the ester alkyl group, and (B) 0.1% to 45% by weight, preferably 0.5 to 25% by weight, often 0.5 to 20% or 0.5 to 10%, often 1% to 20%, more preferably 1 to 10%, and in one embodiment 1.5 to 8% by weight of at least one nitrogen-containing monomer selected from the group consisting of vinyl substituted nitrogen heterocyclic monomers, dialkylaminoalkyl acrylate monomers, dialkylaminoalkyl acrylamide monomers, N-tertiary alkyl acrylamides, and vinyl substituted amines, provided that the total of the percentages of (A) and (B) equals 100%. The reaction is optionally conducted also in the presence of a chain transfer agent.

In a preferred process, monomer (A), the free radical initiator, and the chain transfer agent, if any, are first combined to form a mixture, whereupon 10% to 80% of said mixture is mixed with monomer (B), heating 20% to 100%, often 20% to 80%, more often 30% to 60%, and in one preferred embodiment 100%, of the resulting mixture until an exotherm is noted, then, while maintaining reaction temperature, first adding the balance, if any, of the mixture of monomers (A) and (B) over 0.25 hour to 5 hours followed by addition over 0.25 to 5 hours of the remaining mixture of monomer (A) and initiator, and then optionally adding additional initiator as may be required, whereupon the reaction is continued to completion. Any combination of the foregoing ratios of reactants is useful provided the total percentages equals 100%.

In one embodiment the dispersant viscosity modifier is prepared by polymerizing 57.5 parts methyl methacrylate, 12.7 parts butyl methacrylate, 226.5 parts each of $C_{9-11}$ methacrylate and $C_{12-15}$ methacrylate, 114.8 parts $C_{16-18}$ methacrylate and 11.7 parts N-(3-(dimethylamino)propyl) methacrylamide in a staged addition process. Details of the preparation of these and related polymers are found in European Patent Application 750,031, published Dec. 27, 1996.

The copolymers described above typically have a weight average molecular weight ($\overline{M}_w$) of 10,000 to 500,000, more often 30,000 to 250,000, frequently 20,000 to 100,000 and polydispersity values ($\overline{M}_w/\overline{M}_n$) of 1.2 to 5. Molecular weights of polymers are determined using well-known methods described in the literature.

Normally the amount of VM will be 1 to 25 percent by weight of the composition; preferably the amount will be 2 to 20 percent by weight, and more preferably 5 to 15 percent by weight.

Another common component for ATFs and CVT fluids is a phosphorus compound. Most phosphorus compounds impart a measure of anti-wear performance to the composition.

The phosphorus compound can be a phosphorus acid or ester of the formula $(R^1X)(R^2X)P(X)_nX_mR^3$ or a salt thereof, where each X is independently an oxygen atom or a sulfur atom, n is 0 or 1, m is 0 or 1, m+n is 1 or 2, and $R^1$, $R^2$, and $R^3$ are hydrogen or hydrocarbyl groups. Preferably at least one of $R^1$, $R^2$, and $R^3$ is a hydrocarbyl group, and preferably at least one is hydrogen. This component thus includes phosphorous and phosphoric acids, thiophosphorous and thiophosphoric acids, phosphite esters, phosphate esters, and thiophosphite and thiophosphate esters. The esters can be mono-, di- or tri-hydrocarbyl esters. It is noted that certain of these materials can exist in tautomeric forms, and that all such tautomers are intended to be encompassed by the above formula and included within the present invention. For example, phosphorous acid and certain phosphite esters can be written in at least two ways, $(RO)_2$—PH (=O) and $(RO)_2$—P—OH, differing merely by the placement of the hydrogen. Each of these structures are intended to be encompassed by the present invention.

The phosphorus-containing acids can be at least one phosphate, phosphonate, phosphinate or phosphine oxide. These pentavalent phosphorus derivatives can be represented by the formula $(R^1O)(R^2O)(R^3O)P{=}O$ wherein $R^1$, $R^2$ and $R^3$ are independently hydrocarbyl groups, or hydrogen. The phosphorus-containing acid can be at least one phosphite, phosphonite, phosphinite or phosphine. These trivalent phosphorus derivatives can be represented by the formula $(R^1O)(R^2O)(R^3O)P$ wherein $R^1$, $R^2$ and $R^3$ are independently hydrocarbyl groups. The total number of carbon atoms in $R^1$, $R^2$ and $R^3$ in each of the above formulae should be sufficient to render the compound soluble in the medium. Generally, the total number of carbon atoms in $R^1$, $R^2$ and $R^3$ is at least 8, and in one embodiment at least 12, and in one embodiment at least 16. There is no limit to the total number of carbon atoms in $R^1$, $R^2$ and $R^3$ that is required, but a practical upper limit is 400 or 500 carbon atoms. In one embodiment, $R^1$, $R^2$ and $R^3$ in each of the above formulae are independently hydrocarbyl groups of preferably 1 to 100 carbon atoms, or 1 to 50 carbon atoms, or 1 to 30 carbon atoms. Each $R^1$, $R^2$ and $R^3$ can be the same as the other, although they may be different. Examples of useful $R^1$, $R^2$ and $R^3$ groups include hydrogen, t-butyl, isobutyl, amyl, isooctyl, decyl, dodecyl, oleyl, $C_{18}$ alkyl, eicosyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and the like.

In another embodiment, the phosphorus acid is characterized by at least one direct carbon-to-phosphorus linkage such as those prepared by the treatment of an olefin polymer, such as one or more of the above polyalkenes (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride.

It is preferred that at least two of the X atoms in the above structure are oxygen, so that the structure will be $(R^1O)(R^2O)P(X)_nX_mR^3$, and more preferably $(R^1O)(R^2O)P(X)_nX_mH$. This structure can correspond, for example, to phosphoric acid when $R^1$, $R^2$, and $R^3$ are hydrogen. Phosphoric acid exists as the acid itself, $H_3PO_4$ and other forms equivalent thereto such as pyrophosphoric acid and anhydrides of phosphoric acid, including 85% phosphoric acid (aqueous), which is the commonly available commercial grade material. The formula can also correspond to a mono- or dialkyl hydrogen phosphite (a phosphite ester) when one or both of $R^1$ and $R^2$ are alkyl respectively and $R^3$ is hydrogen, or a trialkyl phosphite ester when each of $R^1$, $R^2$, and $R^3$ is alkyl; in each case where n is zero, m is 1, and the remaining X is O. The structure will correspond to phosphoric acid or a related material when n and m are each 1; for example, it can be a phosphate ester such as a mono-, di- or trialkyl monothiophosphate when one of the X atoms is sulfur and one, two, or three of $R_6$, $R_7$, and $R_8$ are alkyl, respectively.

Phosphoric acid and phosphorus acid are well-known items of commerce. Thiophosphoric acids and thiophosphorous acids are likewise well known and are prepared by reaction of phosphorus compounds with elemental sulfur or other sulfur sources. Processes for preparing thiophosphorus acids are reported in detail in *Organic Phosphorus Compounds.,* Vol. 5, pages 110–111, G. M. Kosolapoff et al., 1973.

The $R^1$ and $R^2$ groups can comprise a mixture of hydrocarbyl groups derived from commercial alcohols. Examples of some preferred monohydric alcohols and alcohol mixtures include the commercially available Alfol™ alcohols marketed by Continental Oil Corporation. Alfol™ 810, for instance, is a mixture containing alcohols consisting essentially of straight-chain primary alcohols having from 8 to 10 carbon atoms. Another commercially available alcohol mixture is Adol™ 60 which comprises about 75% by weight of a straight-chain $C_{22}$ primary alcohol, about 15% of a $C_{20}$ primary alcohol, and about 8% of $C_{18}$ and $C_{24}$ alcohols. The Adol™ alcohols are marketed by Ashland Chemical.

A variety of mixtures of monohydric fatty alcohols derived from naturally occurring triglycerides and ranging in chain length from $C_8$ to $C_{18}$ are available from Procter & Gamble Company. Another group of commercially available mixtures include the Neodol™ products available from Shell Chemical Co. Other alcohols which can be used are lower molecular weight alcohols such as methanol, ethanol, propanol, isopropanol, normal butanol, isobutanol, tertbutanol, the pentanols, hexanols, heptanols, octanols (including 2-ethyl hexanol), nonanols, decanols, and mixtures thereof.

The dihydrocarbyl hydrogen phosphites of this invention can be prepared by techniques well known in the art, and many such phosphites are available commercially.

In one embodiment, the phosphorus-containing agent is a hydrocarbyl phosphate. The phosphate may be a mono-, di- or trihydrocarbyl phosphate. Hydrocarbyl phosphates can be prepared by reacting phosphorus acid or anhydride, preferably phosphorus pentoxide with an alcohol at a temperature of 30° C. to 200° C., preferably 80° C. to 150° C. The phosphorus acid is generally reacted with the alcohol in a ratio of about 1:3.5, preferably 1:3.

In another embodiment, the hydrocarbyl phosphate can be a hydrocarbyl thiophosphate. Thiophosphates may contain from one to three sulfur atoms, preferably one or two sulfur atoms. The thiophosphates may have the same hydrocarbyl group as described above. Thiophosphates are prepared by reacting one or more of the above-described phosphites with a sulfurizing agent including sulfur, sulfur halides, and sulfur containing compounds, such as sulfurized olefins, sulfurized fats, mercaptans and the like.

In another embodiment, the phosphorus compound can be a phosphorus-containing amide. Phosphorus-containing amides are generally prepared by reacting one of the above-described phosphorus acids such as a phosphoric, phosphonic, phosphinic, thiophosphoric, including dithiophosphoric as well as monothiophosphoric, thiophosphinic or thiophosphonic acids with an unsaturated amide, such as an acrylamide. Preferably the phosphorus acid is a dithiophosphorus acid prepared by reacting a phosphorus sulfide with an alcohol or phenol to form dihydrocarbyl dithiophosphoric acid. The hydrocarbyl groups may be those described above for hydrocarbyl phosphates.

The phosphorus-containing amides can be prepared by the reaction of a phosphorus-containing acid, preferably a dithiophosphoric acid, as described above with an acrylamide such as acrylamide, N,N'-methylenebisacrylamide, methacrylamide, crotonamide, and the like. The reaction product from above may be further reacted with linking or coupling compounds, such as formaldehyde or paraformaldehyde to form coupled compounds.

The phosphorus compound can also be an amine salt of the foregoing acidic materials.

Examples of phosphorus-containing materials are phosphites and phosphates such as dibutyl phosphite, diphenylphosphite, triphenylphosphite, tricresylphosphate and triphenylthiophosphate.

The amount of the phosphorus containing compound or compounds in the fully formulated fluids of the present invention will typically be 0.05 to 5 percent by weight, preferably 0.1 to 2 percent, and more preferably 0.2 to 1 percent by weight. The amount of such compounds will depend to some extent on the specific compound, its molecular weight, phosphorus content, and activity. Typically the fully formulated fluids of the present invention will contain 150 to 1000 parts per million phosphorus, preferably 300 to 500 ppm phosphorus.

Another common component of ATFs and CVT fluids is one or more friction modifiers. Friction modifiers are very well known in the art, and the number and types of compounds are voluminous. In general, friction modifiers include metal salts of fatty acids, fatty phosphites, fatty acid amides, fatty epoxides and borated derivatives thereof, fatty amines, glycerol esters and their borated derivatives, alkoxylated fatty amines (including ethoxylated fatty amines such as diethoxylated tallowamine) and their borated derivatives, isostearic acid condensation products of polyamines such as tetraethylene pentamine, such condensates containing amide and imidazoline or imine functional groups, sulfurized olefins, sulfurized polyolefins, sulfurized fats, and sulfurized fatty acids. They can also be suspended molybdenum disulfide, dialkyl or diaryl dithiophosphate molybdates or alkyl or dialkyl dithiocarbamate molybdates where the molybdenum is oxydisulfidobridged and chelated with dithiophosphate or dithiocarbamate ligands.

Metal salts of fatty acids are well known materials. Fatty acids are generally hydrocarbon-based carboxylic acids, both synthetic and naturally occurring, preferably aliphatic acids, although acids containing aromatic functionality are also included. Occasional heteroatom substitution can be permitted in the hydrocarbyl portion of the fatty acid, consistent with the definition of "hydrocarbyl," below. Preferably the acid contains 14 to 30 carbon atoms, more preferably 16–24 carbon atoms, and preferably about 18 carbon atoms. The acid can be straight chain (e.g. stearic) or branched (e.g., isostearic). The acid can be saturated or it can contain olefinic unsaturation. A preferred acid is oleic acid, and the correspondingly preferred salt is zinc oleate, a commercially available material, the preparation of which is well known and is within the abilities of the person skilled in the art.

The zinc salt can be a neutral salt, that is, in which one equivalent of zinc is reacted with one equivalent of acid such as oleic acid. Alternatively, the zinc salt can be a slightly basic salt, in which one equivalent of a zinc base is reacted with somewhat less than one equivalent of acid. An example of such a material is $Zn_4Oleate_6O_1$.

Alkyl-substituted imidazolines are also well known materials. They can generally be formed by the cyclic condensation of a carboxylic acid with a 1,2 diaminoethane compound. They generally have the structure

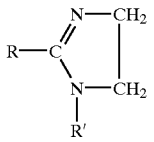

where R is an alkyl group and R' is a hydrocarbyl group or a substituted hydrocarbyl group, including $—(CH_2CH_2NH)_n—H$ groups.

Among the numerous suitable carboxylic acids useful in preparing the imidazoline are oleic acid, stearic acid, isostearic acid, tall oil acids, and other acids derived from natural and synthetic sources. Specially preferred carboxylic acids are those containing 12 to 24 carbon atoms including the 18 carbon acids such as oleic acid and stearic acid. Among suitable 1,2 diaminoethane compounds are compounds of the general structure $R—NH—C_2H_4—NH_2$, where R is a hydrocarbyl group or a substituted hydrocarbyl group (e.g., hydroxy hydrocarbyl, aminohydrocarbyl). A preferred diamine is N-hydroxyethyl-1,2-diaminoethane, $HOC_2H_4NHC_2H_4NH_2$.

A preferred alkyl-substituted imidazoline is 1-hydroxyethyl-2-heptadecenyl imidazoline.

Another type of friction modifier includes borated epoxides, which are described in detail in U.S. Pat. No. 4,584,115, and are generally prepared by reacting an epoxide, preferably a hydrocarbyl epoxide, with boric acid or boron trioxide. The epoxide can be expressed by the general formula

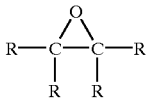

wherein each R is independently hydrogen or a hydrocarbyl group containing 8 to 30 carbon atoms, at least one of which is hydrocarbyl. Also included are materials in which any two of the R groups together with the atoms to which they are attached, for a cyclic group, which can be alicyclic or heterocyclic. Preferably one R is a hydrocarbyl group of 10 to 18 carbon atoms and the remaining R groups are hydrogen. More preferably the hydrocarbyl group is an alkyl group. The epoxides can be commercial mixtures of $C_{14-16}$ or $C_{14-18}$ epoxides, which can be purchased from ELF-ATOCHEM or Union Carbide and which can be prepared from the corresponding olefins by known methods. Purified epoxy compounds such as 1,2-epoxyhexadecane can be purchased from Aldrich Chemicals. Alternatively this material can be a reactive equivalent of an epoxide. By the term "reactive equivalent of an epoxide" is meant a material which can react with a boronating agent (described above) in the same or a similar manner as can an epoxide to give the same or similar products. An example of a reactive equivalent of an epoxide is a diol. Another example of a reactive equivalent to epoxides is the halohydrins. Other equivalents will be apparent to those skilled in the art. Other reactive equivalents include materials having vicinal dihydroxy groups which are reacted with certain blocking reagents. The borated compounds are prepared by blending the boron compound and the epoxide and heating them at a suitable temperature, typically 80° to 250° C., until the desired reaction has occurred. A preferred borated epoxide is the borated epoxide of a predominantly 16 carbon olefin.

The amount of the friction modifier component is preferably 0.1 to 0.45 percent by weight of the composition, preferably 0.15 to 0.3 percent, and more preferably 0.2 to 0.25 percent by weight. The total amount of the friction modifiers (of all types) is preferably that which provides a metal-to-metal coefficient of friction of at least 0.120 as measured at 110° C. by ASTM-G-77, using the composition as a lubricant, since such minimum friction is desirable for the presently contemplated application. Preferably the amount of friction modifiers is sufficient to provide a coefficient of friction of 0.125 to 0.145, and more preferably about 0.135.

Other materials often used in ATFs and CVT fluids include antioxidants, including hindered phenolic antioxidants, secondary aromatic amine antioxidants, sulfurized phenolic antioxidants, oil-soluble copper compounds, phosphorus-containing antioxidants, organic sulfides, disulfides, and polysulfides. Other components include metal deactivators such as tolyltriazole, benzotriazole, and the methylene-coupled product of tolyltriazole and amines such as 2-ethylhexylamine. Such metal deactivators can also be useful in adjusting the metal-to-metal friction in push belt CVTs. Other components can include seal swell compositions, such as isodecyl sulfolane (that is, isodecyl-3-sulfolanyl ether), which are designed to keep seals pliable. Also permissible are pour point depressants, such as alkylnaphthalenes, polymethacrylates, vinyl acetate/fumarate or /maleate copolymers, and styrene/maleate copolymers. These optional materials are known to those skilled in the art, are generally commercially available, and are described in greater detail in published European Patent Application 761,805. Also included can be corrosion inhibitors, dyes, fluidizing agents, and antifoam agents. Each of these materials may be present in conventional and functional amounts.

The composition of the present invention can be supplied as a fully formulated lubricant or functional fluid, or it can be supplied as a concentrate. In a concentrate, the relative amounts of the various components will generally be about the same as in the fully formulated composition, except that the amount of oil of lubricating viscosity will be decreased by an appropriate amount. The absolute percentage amounts of the remaining components will be correspondingly increased. Thus, when the concentrate is added to an appropriate amount of oil, the final formulation of the present invention will be obtained. A typical concentrate of the present invention may contain at least 2500 parts per million of boron.

Thus, in a fully formulated composition, the amount of the oil of lubricating viscosity will typically be a major amount, or 50 to 95 parts by weight. In a concentrate, similarly, the amount of the oil of lubricating viscosity will typically be 10 to 50 parts by weight or other intermediate values that may be appropriate. Other amounts of the various components may be independently selected from a consideration of the broad, preferred, and most preferred percent ranges of such components set forth above. An exhaustive listing of such combinations on a parts-by-weight basis is not recited herein for the sake of brevity; however, such combinations can well be determined by the person skilled in the art seeking to prepare a concentrate.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

EXAMPLES

Example Series A

Formulations for testing are prepared by addition of the additives as noted to a conventional base formulation as set forth below:

| Base Formulation | |
|---|---|
| 100 N oil | 83–86% |
| polymethacrylate viscosity modifier | 6.8% |
| various dispersants (as set forth in the following tables) | 3.5% |
| overbased calcium sulfonate (as Set forth in the following tables) | 0.5–2.3% |
| calcium salicylate | 0.4% |
| alkyl phosphite + phosphoric acid | 0.3% |
| antioxidant(s) | 0.6% |
| red dye | <0.1% |
| diluents | 1.2% |
| antifoam agent(s) | <0.1% |
| sulfur-containing agents | 1.1% |
| borated epoxides | 0.2% |

Each of the foregoing components are listed in their conventional fashion, in that each may contain up to about 50% diluent oil.

The following additional components are used to prepare the fully formulated fluids reported below:

Disp. M: a succinimide dispersant (43% diluent oil)

Disp. M': a different succinimide dispersant (40% diluent oil)

Disp. D: a dimercaptothiadiazole-containing dispersant (49% diluent oil)

Disp. S: a sulfur-containing dispersant (42% diluent oil)

Disp. B: a borated dispersant from the reaction of polyisobutylene-substituted succinic anhydride with polyethyleneamines, followed by reaction with boric acid. The composition contains 1.9% boron (33% diluent oil)

Sal.: a 165 total base number overbased calcium salicylate detergent (40% diluent oil)

Sulf. 10: a 10 total base number overbased calcium sulfonate detergent (50% diluent oil)

Sulf. 300: a 300 total base number overbased calcium sulfonate detergent (50% diluent oil)

Sulf 295B: a 295 total base number overbased calcium sulfonate detergent, borated, composition containing 1.83% boron (50% diluent oil)

ZDDP: a zinc dialkyldithiophosphate (11% diluent oil)

TABLE 1

| | Formulations: Base Formulation With- | | | | | | | | | | | | | |
|---|---|---|---|---|---|---|---|---|---|---|---|---|---|---|
| Example: | 1* | 2* | 3* | 4* | 5 | 6 | 7 | 8 | 9 | 10 | 11 | 12 | 13 | 14 |
| Disp M | 3.5 | | | | | 3.0 | | | | | | | | |
| Disp M' | | 3.5 | | | | | 3.0 | | | | | | | |
| Disp D | | | 3.5 | | | | | 3.0 | | | | | | |
| Disp S | | | | 3.5 | | | | | 3.0 | 3.0 | | 3.0 | | 3.0 |
| Disp B | | | | | 3.5 | 0.5 | 0.5 | 0.5 | 0.5 | 0.5 | 3.5 | 0.5 | 3.5 | 0.5 |
| Sal | 0.4 | 0.4 | 0.4 | 0.4 | 0.4 | 0.4 | 0.4 | 0.4 | 0.4 | 0.4 | 0.4 | | | |
| Sulf 10 | 2.3 | 2.3 | 2.3 | 2.3 | 2.3 | 2.3 | 2.3 | 2.3 | 2.3 | | | | | |
| Sulf 300 | | | | | | | | | | 0.5 | 0.5 | | | 0.5 |
| Sulf 295B | | | | | | | | | | | | 0.7 | 0.7 | |
| ZDDP | | | | | | | | | | | | | | 0.5 |
| ppm B | 37 | 37 | 37 | 37 | 653 | 136 | 127 | 126 | 124 | 121 | 639 | 265 | 762 | 123 |
| ppm Ca | 806 | 785 | 801 | 799 | 783 | 763 | 796 | 763 | 786 | 746 | 754 | 804 | 759 | 765 |
| ppm Zn | 0 | 0 | 0 | 0 | 0 | 0 | 0 | 0 | 0 | 0 | 0 | 0 | 0 | 526 |

*Examples 1–4 are comparative examples.

Amounts of additives are percent by weight.

Each of the amounts in the above table is in percent by weight, except for the amounts of the elements B, Ca, and Zn, which are expressed as parts per million. The lubricants in Table 1 represent those which are blended with Group II basestocks as defined by API.

Each of the materials from examples 1–14 is subjected to two test evaluations known to discriminate among CVT fluids. Test 1 utilizes a FALEX Model 1 Friction Tester fitted to evaluate the performance of each fluid using a CVT push-belt element held in a stationary position, under load, against a rotating Timken ring (ASTM-G77-93, modified). The test conditions include 500 mm/sec, 1000 N, and 100° C. over a 2 hour time period. A description of a related test method and the set up for the test can be found published in Proceedings of the '98 International Symposium of 'Tribology of Vehicle Transmissions', Feb. 4–6, 1998, Yokohama, Japan as Paper 22, Ward, et al, "Belt Drive CVT Fluid Evaluation". The second test is a variation of the first test operating at 3000 mm/sec and 1000 N, to evaluate the seizure properties of CVT fluids.

For comparison, two reference fluids are subjected to the same tests. Reference fluid "NS" is a commercial CVT Fluid, Nissan NS-1, containing ZDDP which is applied to the 2.0 liter Nissan Bluebird, NS is known to have a high metal to metal friction coefficient and good antiseizure characteristics. Reference fluid "MD" is a commercial CVT Fluid, Nissan MATIC D, that is applied to the CVT for less than 2.0 liter engine application. Sample MD is known to have low metal to metal friction characteristics and is also used for automatic transmissions.

The results of tests, shown in the following Tables 2 and 3, summarize the results of the lubricants of the present invention and of the reference lubricants as set forth in Table 1.

TABLE 2

Test 1, Coefficients of Friction (ASTM-G77-93, modified)

| Ex. | Shape of Friction Curve | Minimum Friction Coefficient | Average Friction Coefficient |
|---|---|---|---|
| NS | Linear, Stable, Slightly Increasing | .128 | .131 |
| MD | Decreasing | .095 | .105 |
| 1*[a] | Piarabolic[b] | .106 | .121 |
| 2* | Parabolic | .109 | .121 |
| 3* | Decreasing | .093 | .112 |
| 4* | Parabolic | .102 | .120 |
| 5 | Linear, Stable, Slightly Increasing | .121 | .127 |
| 6 | Linear, Stable, Slightly Increasing | .124 | .128 |
| 7 | Parabolic | .109 | .122 |
| 8 | Decreasing | .110 | .124 |
| 9 | Parabolic then Linear, Slightly Increasing | .105 | .122 |
| 10 | Linear, Slightly Increasing | .103 | .125 |
| 11 | Linear, Stable, Slightly Increasing | .119 | .126 |
| 12 | Linear, Stable, Slightly Increasing | .123 | .127 |
| 13 | Linear, Stable, Slightly Increasing | .129 | .133 |
| 14 | Linear, Stable, Slightly Increasing | .121 | .130 |

*Comparative Examples

[a]Example exhibits transient spikes to coefficient of friction greater than 0.14

[b]"Parabolic" refers to a plot of coefficient of friction as a function of time which exbibits a decrease in coefficient over a period of typically 20–40 minutes, followed by a period of relatively constant, low friction, followed by an increase in friction coefficient.

The comparisons shown in Table 2 illustrate an advantage of the borated dispersant and/or borated detergent-containing lubricant compositions of the present invention. A comparison of Example 5 with Comparative Examples 1–4 in Table 1 shows that the borated dispersant imparts improved stability to the coefficient of friction. Examples 6–9 show that even a lower amount of borated dispersant can stabilize a CVT element with respect to metal friction, in the presence of another dispersant. Examples 10 and 11 show that a higher level of borated dispersant has a greater stabilizing effect on friction than does a lower level. Examples 12 and 13, compared with Example 14, further show that formulations prepared using a borated detergent along with a borated dispersant can exhibit stable friction coefficients as high as those of formulations prepared with primary ZDDP. A particularly high and stable friction level is obtained in samples which contain a combination of a high treatment level of borated dispersant along with a 295 TBN borated calcium sulfonate. This combination of components provides an advantage over compositions containing ZDDP, in that the latter formulations can suffer from to composite clutch friction material clogging and glazing, leading to degradation of clutch friction and ultimately to shudder and slippage of clutches.

TABLE 3

Test 2, Seizure Test (ASTM-G77-93, modified)

| Example | Time to seize (min) | ppm boron |
|---|---|---|
| NS | >120 | — |
| MD | 708 | 653 |
| 9 | 9 | 124 |
| 10 | 0 | 121 |
| 11 | >120 | 639 |
| 12 | 53 | 265 |
| 13 | >120 | 762 |
| 14 | >120 | 123 |

The comparisons set forth for Test 2 in Table 3 show that, even within compositions containing borated detergents or dispersants, the choice of detergent and dispersant can play an important role in determining the antiseizure characteristics (CVT element on metal) of the CVT fluid formulations. The Results of Examples 5 versus 9 and 11 versus 10 illustrate the added benefit derived from using a higher level of borated dispersant. Examination of the results of Examples 11 and 5 illustrates that using a high level of a borated dispersant, even without a borated detergent, can provide good antiseizure properties similar to those obtained in formulations containing ZDDP (compare with Examples NS and 14). Examination of Examples 12 and 10 shows that antiseizure properties are further improved when a borated detergent is used, in addition to the borated dispersant. Example 13 shows that excellent overall performance is obtained by using a combination of borated dispersant and borated detergent, as judged by the higher friction coefficients in Table 2 in combination with the excellent antiseizure results in Table 3.

Example Series B

Further evaluations are conducted on the additive formulations of Example 11 and 13 as shown in Table 4. In Table 4, Examples 11A and 13A are reblends of the formulas of Examples 11 and 13, respectively. Examples 15–20 are formulations based on Examples 11 and 13, but further containing additional components as listed. Supplement A is hydroxyethylated fatty amine; Supplement B is the condensate of isostearic acid and tetraethylene pentamine; and Supplement C is a fatty dialkyl phosphite. The 100° C. viscosity of each test sample is reported. Test 2 (as set forth above) is run on several of the examples reported in Table 4. The results show excellent antiseizure properties, consistent with the results obtained in Table 3. The results indicate that consistent good antiseizure performance is also obtained in the presence of Supplements A, B and C, which are commonly used as friction modifiers for ATF.

TABLE 4

| Example: | 11A | 15 | 16 | 17 | 13A | 18 | 19 | 20 |
|---|---|---|---|---|---|---|---|---|
| Same as Example 11 | X | X | X | X | | | | |
| Same as Example 13 | | | | | X | X | X | X |
| Supplement A | | 0.2 | | | | 0.2 | | |
| Supplement B | | | 0.2 | | | | 0.2 | |
| Supplement C: | | | | 0.1 | | | | 0.1 |
| ASTM D445, cSt (100° C.) | 7.31 | 7.32 | 7.33 | 7.33 | 7.33 | 7.33 | 7.36 | 7.33 |
| Test 2, minutes to seizure | — | >120 | >120 | – | >120 | >120 | >120 | >120 |

(note:
"—" means "not determined. Amounts of supplements are percent by weight.)

The examples in Table 4 were also evaluated in Test 3 and Test 4. Test 3 is another CVT element on metal contact surface test, while Test 4 is a low velocity friction test (LVFA). These additional test methods further demonstrate the utility of the present boron containing formulations.

Test 3 is termed a "3 Element Test". The 3 Element type test is described in technical paper "CVT Lubrication: The Effect of Lubricants on the Frictional Characteristics of the Belt-Pulley Interface" given in the 1997 CEC Conference in Goteborg, Sweden (CEC97-TLO6) by Watts, et al. Although this paper describes the general setup of a three-element tester, the test fixture used to evaluate the samples in Table 4 is modified somewhat. The test procedure is similar to that given in Draft ZF Friedrichshafen AG specification ZFN 13026/November 1998, Section 16.11.3 and is as follows:

Using a normal force of 1600 newtons, a sliding speed of 400 mm/s, evaluating at three temperatures (40, 80, and 110° C. sump temperature), and holding each temperature for 1 hour duration, take one torque measurement every 30 seconds and average them for each temperature.

The test results are compared to those obtained by testing a European commercial reference fluid known as EZL799 ("EZL"). The goal of this test is to obtain a fluid which maintains a higher friction coefficient than does "EZL." Results for Test 3 are provided in Table 5. For several of the examples, the drain fluid from a DKA oxidation test is additionally evaluated as an indication of the CVT Element-on-metal friction durability. The goal of this evaluation is to obtain a fluid which shows no decrease in friction coefficient after being subjected to the oxidation test. The DKA oxidation test is run at 160° C. for 192 hours to stress the fluid.

TABLE 5

Test 3, 3 Element Test at 3 Temperatures

| | Friction Coefficient New Fluid | | | Friction Coefficient DKA Oxidation Drain | | |
|---|---|---|---|---|---|---|
| Example: | 40° C. | 80° C. | 110° C. | 40° C. | 80° C. | 110° C. |
| EZL | 0.127 | 0.127 | 0.127 | 0.120 | 0.119 | 0.120 |
| 11A | 0.133 | 0.134 | 0.141 | 0.128 | 0.137 | 0.146 |
| 15 | 0.125 | 0.129 | 0.136 | 0.128 | 0.133 | 0.140 |
| 16 | 0.129 | 0.131 | 0.136 | 0.121 | 0.130 | 0.138 |
| 17 | 0.139 | 0.141 | 0.146 | — | — | — |
| 13A | 0.137 | 0.140 | 0.146 | 0.123 | 0.129 | 0.139 |
| 18 | 0.121 | 0.131 | 0.135 | 0.130 | 0.140 | 0.146 |
| 19 | 0.125 | 0.127 | 0.131 | 0.126 | 0.130 | 0.138 |
| 20 | 0.134 | 0.136 | 0.143 | — | — | — |

Comparison of the fluids in Table 5 indicates that every formulation of the present invention which was tested provides equal or higher coefficient of friction than does the EZL fluid at the higher temperatures. The reference fluid (EZL) shows a consistent decrease in the 3-Element friction coefficient after oxidation, while most of the formulations of the present invention show an increase in friction after oxidation. Importantly, the formulations of the present invention tested give higher 3-Element-on-metal friction coefficients after oxidation than does EZL, in particular at higher temperatures. This result is important because the higher temperatures represent the relatively more severe conditions in the field. Lower metal-metal friction coefficients under severe conditions would lead to increased slip ratios between the input and output pulleys. When the slip ratio becomes too high, seizure may occur, causing catastrophic failure of the transmission.

The data in Tables 4 and 5, therefore, show the utility of the present high boron formulations for increasing the friction coefficient and thereby improving belt-pulley efficiency while imparting good antiseizure properties to the CVT element-on-metal interface.

Table 6 shows summary results of low velocity friction testing (LVFA) on composite clutch friction material. This type of testing has been discussed in detail by Willermet et al. in SAE publication 982668, as a method for testing automatic transmission fluids to predict aging in the field due to oxidation and to predict shudder in modulated (slipping, controlled slipping) torque converter clutches in the field. The data reported in Table 6 are values which are calculated as the average slope, in terms of change in friction coefficient as a function of sliding speed, calculated electronically at numerous points between 4 m/s and 16 m/s sliding speed, under approximately 25 kg (245 N) applied force. Samples are evaluated at 40, 100 and 150° C. Negative slope given as hundredths (e.g., −0.01) is poor while negative slopes given as thousandths (e.g., −0.004) or positive slope is good. The novel high boron compositions are tested by this method and compared to several reference fluids, including ATFs with known antishudder performance. Reference examples NS, MD and EZL represent a comparison with CVT fluids; "MD" is known to have poor antishudder performance. Reference examples T3 and T4 are automatic transmission fluids of known good antishudder performance as reported in SAE publication 972927 by Kugimiya et al. and by and Ueda et al., with T4 reported to be better than T3. Example C is an ATF of known good antishudder performance in the GM ECCC clutch, as reported in "ATF Antishudder Evaluation Using The ECCC," Petroleum Product Symposium, Ward et al., JPI, November 1998. Tests are performed on new (fresh) fluids as well as on fluids which have been oxidatively aged by subjecting them to the 300 hour ABOT test.

TABLE 6

| Test 4, LVFA Test at 3 Temperatures | | | | | | |
|---|---|---|---|---|---|---|
| | Average Slope of Friction Coefficient | | | | | |
| | New Fluid | | | 300 hour ABOT | | |
| Example | 40° C. | 100° C. | 150° C. | 40° C. | 100° C. | 150° C. |
| NS | 0.0042 | 0.0136 | 0.0054 | −0.0131 | −0.0207 | −0.0242 |
| MD | 0.0132 | 0.0112 | 0.0035 | −0.0145 | −0.0185 | −0.0141 |
| BZL | 0.0024 | 0.0090 | 0.0086 | −0.018 | −0.0331 | −0.0175 |
| T3 | 0.0053 | 0.0028 | 0.0097 | −0.0161 | −0.0240 | −0.0111 |
| T4 | 0.0020 | 0.0043 | 0.0054 | −0.00142 | 0.0032 | 0.00169 |
| C | 0.0068 | 0.0079 | 0.0075 | −0.0042 | 8.89E−05 | 0.0020 |
| 11A | 0.00099 | 0.0029 | 0.0037 | 0.00038 | 0.0023 | 0.0039 |
| 15 | 0.0084 | 0.0087 | 0.0060 | 0.0028 | 0.0033 | 0.0055 |
| 16 | −1.8E−05 | 0.0063 | 0.0077 | −0.00018 | 0.0045 | 0.0066 |
| 17 | 0.00123 | −0.00013 | 0.0038 | −0.0025 | 0.0023 | 0.0059 |
| 13A | −0.0040 | 0.00197 | 0.0061 | 0.00199 | 0.0029 | 0.0046 |
| 18 | 0.0065 | 0.0108 | 0.0148 | −0.00065 | 0.0043 | 0.0030 |
| 19 | 7.86E−05 | 0.0056 | 0.0089 | −0.00012 | 0.00301 | 0.0048 |
| 20 | −0.0032 | 0.00083 | 0.0058 | −0.0039 | 0.0033 | 0.0039 |

All the Examples reported in Table 6 exhibit good initial LVFA characteristics; however, after oxidation, Reference materials NS, MD, EZL, and T3 show deterioration of friction properties as evidenced by negative slope. Examples 11A, 13A, and 15–20 show good performance, with calculated slopes consistent with those of materials T4 and C. Examination of the data in Table 6 shows that the present boron containing lubricant compositions can be advantageously used in automatic transmissions which employ slipping (modulated) torque converter clutches for improved antishudder.

Example Series C

Viscosity measurements are performed on the formulations of Examples 11, 13, and 18, blended, however, in a Group III Basestock, rather than the original formulations in a Group II Basestock. The formulations also contain a shear-stable polymethacrylate viscosity index modifier. In Table 7, the notations A, B, and C represent successive reblendings of such formulations.

TABLE 7

| Typical characteristics in API Group III Basestock/Shear Stable PMA Viscosity Index Improver (Viscosity Modifier) | | | | |
|---|---|---|---|---|
| Example | 11B | 13B | 13C | 18A |
| D445, cSt at 100° C. | 7.01 | 6.93 | 6.94 | 6.96 |
| D445, cSt at 40° C. | 28.31 | 31.84 | 32.20 | 32.38 |
| Viscosity Index | 191 | 187 | 184 | 184 |
| D2983, Brookfield, cP at −40° C. | 8450 | 8410 | 9340 | 9470 |

The results demonstrate the utility of the present additives to prepare formulations which meet state-of-the-art lubricant specification requirements.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A method for lubricating a continuously variable transmission, comprising supply thereto a composition comprising (a) an oil of lubricating viscosity;

(b) a borated dispersant; and (c) a borated detergent;

wherein the amount of boron is at least about 250 parts per million, based on the composition, and is present in an amount sufficient to impart improved friction and anti-seizure properties to said composition when employed in said transmission.

2. The method of claim 1 wherein total amount of boron present in the composition is about 400 to about 2000 parts per million.

3. The method of claim 1 wherein total amount of boron present in the composition is about 600 to about 1300 parts per million.

4. The method of claim 1 wherein the oil of lubricating viscosity comprises a mineral oil.

5. The method of claim 1 wherein the oil of lubricating viscosity is a synthetic oil.

6. The method of claim 1 wherein the oil of lubricating viscosity is a traction oil.

7. The method of claim 1 wherein the dispersant comprises an acylated amine, a carboxylic ester, a Mannich reaction product, or a hydrocarbyl substituted amine.

8. The method of claim 1 wherein the dispersant is the reaction product of a carboxylic acylating agent and an amine.

9. The method of claim 1 wherein the dispersant is a succinimide dispersant.

10. The method of claim 1 wherein the dispersant is a borated dispersant from the reaction of polyisobutylene-substituted succinic anhydride, polyethyleneamines, and boric acid.

11. The method of claim 1 wherein the dispersant is present in an amount of about 0.1 to 6 percent by weight of the composition.

12. The method of claim 1 wherein the dispersant is present in an amount of 0.5 to 3 percent by weight.

13. The method of claim 1 wherein the borated dispersant contributes 50 to 3000 parts per million boron to the composition.

14. The method of claim 1 wherein the detergent comprises an overbased alkali metal or alkaline earth metal salt of a sulfonic acid, phenol, carboxylic acid, or phosphorus-containing acid.

15. The method of claim 1 wherein the detergent is a carbonated overbased calcium sulfonate or a carbonated overbased calcium salicylate.

16. The method of claim 1 wherein the borated detergent contributes about 50 to about 3000 parts per million boron to the composition.

17. The method of claim 1 wherein the amount of the detergent is about 0.1 to about 5 percent by weight of the composition.

18. The method of claim 1 wherein the amount of the detergent is about 0.3 to about 2.5 percent by weight of the composition.

19. A composition comprising (a) an oil of lubricating viscosity;

(b) a borated succinimide dispersant or a borated Mannich dispersant; and (c) a borated detergent;

wherein the amount of boron is at least about 250 parts per million, based on the composition, and is present in an amount sufficient to impart improved friction and anti-seizure properties to said composition when employed in a continuously variable transmission.

20. The composition of claim 19 wherein total amount of boron present in the composition is about 400 to about 2000 parts per million.

21. The composition of claim 19, wherein total amount of boron present in the composition is about 600 to about 1300 parts per million.

22. The composition of claim 19 wherein the oil of lubricating viscosity comprises a mineral oil, a synthetic oil, or a traction oil.

23. The composition of claim 19 wherein the dispersant is a borated dispersant from the reaction of polyisobutylene-substituted succinic anhydride, polyethyleamines, and boric acid.

24. The composition of claim 19 wherein the dispersant is present in an amount of about 0.1 to 6 percent by weight the composition.

25. The composition of claim 19 wherein the dispersant is present in an amount of 0.5 to 3 percent by weight.

26. The composition of claim 19 wherein the borated dispersant contributes 50 to 3000 parts per million boron to the composition.

27. The composition of claim 19 wherein the detergent comprises an overbased alkali metal or alkaline earth metal salt of a sulfonic acid, phenol, carboxylic acid, or phosphorus-containing acid.

28. The composition of claim 19 wherein the detergent is a carbonated overbased calcium sulfonate or a carbonated overbased calcium salicylate.

29. The composition of claim 19 wherein the borated detergent contributes about 50 to about 3000 parts per million boron to the composition.

30. The composition of claim 19 wherein the amount of the detergent is about 0.1 to about 5 percent by weight of the composition.

31. The composition of claim 19 wherein the amount of the detergent is about 0.3 to about 2.5 percent by weight of the composition.

32. The composition of claim 19 further comprising a viscosity modifier, a phosphorus compound, a friction modifier, and an antioxidant.

33. The composition of claim 19 wherein the composition is substantially free from zinc dihydrocarbyldithiophosphate.

34. A concentrate comprising (a) a concentrate-forming amount of an oil of lubricating viscosity;

(b) a borated succinimide dispersant or a borated Mannich dispersant; and (c) a borated detergent;

wherein the amount of boron is at least about 2500 parts per million, based on the concentrate.

35. The method of claim 1 wherein the borated detergent is an overbased calcium detergent.

36. The composition of claim 19 wherein the borated detergent is an overbased calcium detergent.

37. The method of claim 1 wherein the total amount of boron in the composition is at least 700 parts per million.

38. The composition of claim 19 wherein the amount of boron in the composition is at least about 700 parts per million.

* * * * *